US006132281A

United States Patent [19]

Klitsner et al.

[11] Patent Number: 6,132,281

[45] Date of Patent: Oct. 17, 2000

[54] MUSIC TOY KIT

[75] Inventors: Daniel Klitsner, Larkspur; Brian Clemens, San Francisco, both of Calif.; Christian Lemire; Solange Jacques, both of Montreal, Canada; Drew Stevenson, Cromwell, Conn.

[73] Assignee: Ritvik Holdings Inc., Quebec, Canada

[21] Appl. No.: 09/490,872

[22] Filed: Jan. 24, 2000

[51] Int. Cl.[7] ..... A63H 33/04

[52] U.S. Cl. ..... 446/75; 446/408; 446/397

[58] Field of Search ..... 446/1, 69, 71, 446/72, 73, 75, 76, 77, 81, 85, 118, 297, 397, 404, 408

[56] References Cited

U.S. PATENT DOCUMENTS

| | | | |
|---|---|---|---|
| 243,096 | 6/1881 | Bailey | 446/71 |
| 3,591,974 | 7/1971 | Thornell | 446/75 |
| 5,349,129 | 9/1994 | Wisniewski et al. | 446/397 |
| 5,474,483 | 12/1995 | Sun | 446/71 |
| 5,643,038 | 7/1997 | Olsen et al. | 446/75 |
| 5,674,103 | 10/1997 | Bean | 446/75 |

*Primary Examiner*—Sam Rimell

*Attorney, Agent, or Firm*—Michael D. Bednarek; Shaw Pittman

[57] ABSTRACT

A music toy kit combining a music toy instrument like a piano or a drum, with a set of construction toy blocks. The music toy instrument is provided with coupling elements similar to or compatible with those of the construction toy blocks and at least some of the blocks are provided with a music score on at least one of their sides, whereby, in use, one may stack one or more of the construction toy blocks onto the music toy instrument and use these blocks as a combined music stand and score to play a given tune.

11 Claims, 3 Drawing Sheets

MUSIC TOY KIT

BACKGROUND OF THE INVENTION a) Field of the Invention

The present invention relates to a music toy kit.

More specifically, it relates to a music toy kit combining a music toy instrument like a piano or a drum, with a set of construction toy blocks. The music toy instrument is provided with coupling elements similar to or compatible with those of the construction toy blocks and at least some of the blocks are provided with a music score on at least one of their sides, whereby, in use, one may stack one or more of the construction toy blocks onto the music toy instrument and use these blocks as a combined music stand and score to play a given tune.

b) Brief Description of the Prior Art

Music toy instruments in the form of pianos, drums or xylophones are well known and commonly offered for sale to children. In such toys, the keys corresponding to the notes to be played are usually provided with identification means such as letters, symbols, colors and the like, thereby making it possible for a child to play a tune upon <<reading>> a score where the notes are identified with the same identification means.

On the other hand, construction toy blocks provided with coupling means usually in the form of vertical pegs, that make them stackable one above the other, have been known for years and are still commonly offered for sale to children on a very large scale worldwide.

SUMMARY OF THE INVENTION

The object of the present invention is to provide a music toy kit which combines, in a very efficient yet interesting way, a music toy instrument of a conventional structure with construction toy blocks also of a conventional structure, in such a manner that both of these toys may be used together for playing purpose.

To achieve such a combination, the music toy instrument has a case provided with coupling means similar to or compatible with those of the construction toy blocks, thereby making it possible for a child to stack one or more blocks on the music toy instrument like he or she would do on a conventional construction toy base. On the other hand, some of the construction toy blocks are provided with a score on at least one of their sides, whereby these blocks can be used as a combined music stand and score to play a given tune when they are stacked onto the case.

Thus, the invention provides a music toy kit comprising in combination:

a) a music toy instrument comprising:
- a case;
- a set of keys corresponding to different notes, each of the keys being provided with identification means and being connected to a sound generator embedded into the case for producing a corresponding note upon actuation of the key; and
- coupling elements integral to the case for connecting construction toy block onto said case; and b) a plurality of these construction toy blocks provided with coupling elements compatible with those integral to the case, each of the construction toy block having at least one side provided with a score wherein the notes to be played are identified with the identification means of the corresponding keys of the music toy instrument, whereby, in use, one may stack one or more of the construction toy blocks onto the case of the music toy instrument and use said one or more blocks as a combined music stand and score to play a given tune by proper actuation of the corresponding keys.

In accordance with a particularly preferred embodiment of the invention, the case is hollow and defines a container for storing the construction toy blocks.

In practice, the music toy instrument can be shaped as a piano. In such a case, the keys are aligned on a front side of the case to form a keyboard.

Alternatively, the music toy instrument can be shaped as a drum. In such a case, the keys are distributed, preferably equally, on a top surface of the drum.

Of course, the music toy instrument may also take other shapes if such is needed.

The invention and its advantages will be better understood upon reading the following non-restrictive description of two preferred embodiments thereof, made with references to the accompanying drawings.

DETAILED DESCRIPTION OF TWO PREFERRED EMBODIMENTS

The music toy kit 1 according to the first preferred embodiment of the invention shown in FIGS. 1 to 5 of the drawings comprises, in combination, a music toy instrument 3 shaped as a piano, and a plurality of construction toy blocks 5, 7 and 9.

Figure 1:
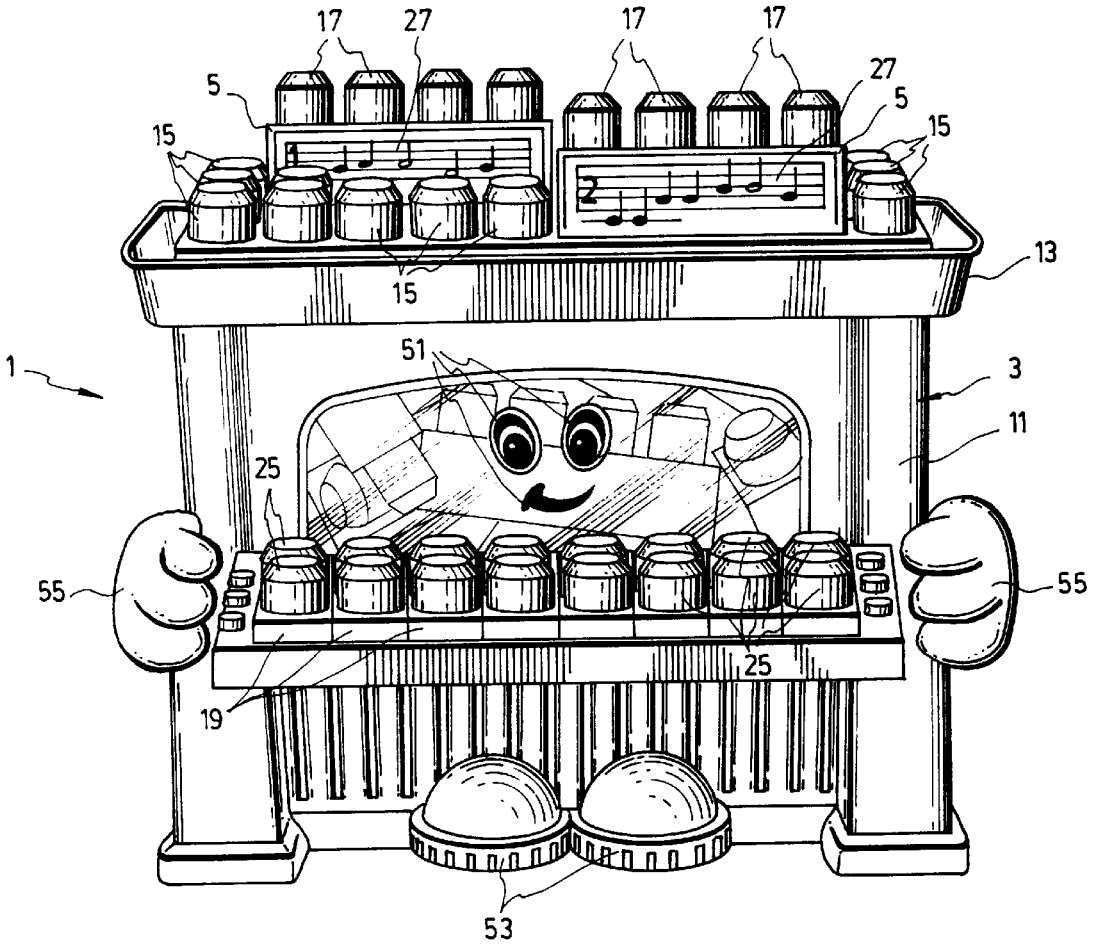
FIG. 1 is a front perspective view of a music toy kit according to a first preferred embodiment of the invention, wherein the music toy instrument is shaped as a piano.
Figure 3:
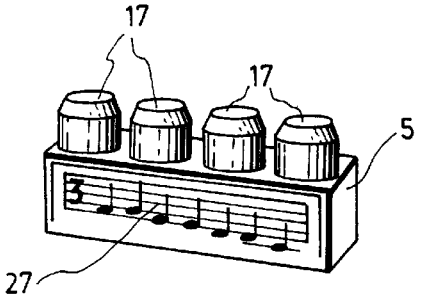
FIG. 3 is a front perspective view of a construction toy block on which a score is provided.
Figure 2:
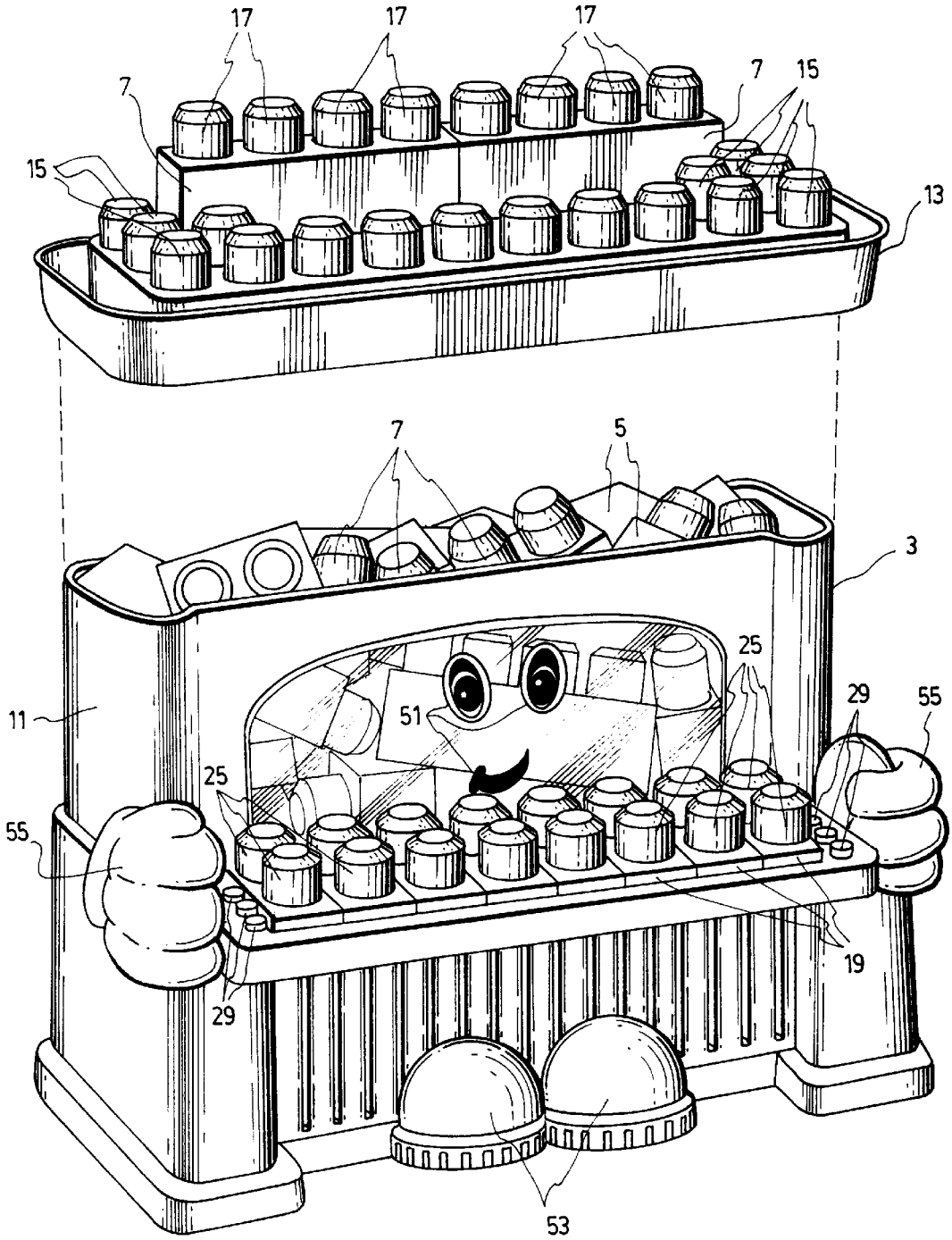
FIG. 2 is a side perspective view of the music toy kit shown in FIG. 1, wherein the top surface of the piano which acts as a lid, is in removed position.
Figure 4:
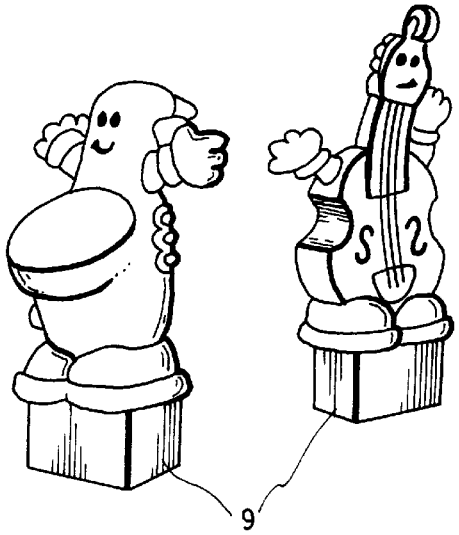
FIG. 4 is a front perspective view of other kind of construction toy blocks that may be parts of the kit.

The piano 3 comprises a case 11, preferably made of plastic material, which is hollow to define a container for storing the construction toy blocks (see FIG. 2). The case 11 has a top surface 13 which is devised to act as a lid for closing the container in which the construction toy block are stored. This top surface 13 is provided with coupling elements in the form of pegs 15 that project upwardly and are regularly spaced apart. These pegs 15 are devised to connect the construction toy blocks 5, 7, 9 onto the case 11 as is shown in FIG. 1.

For this purpose, all the construction toy blocks must be provided with coupling elements compatible with the pegs 15. These compatible elements may consist of cavities (not shown) provided under each of the blocks to snugly receive corresponding pegs and thus allow the blocks to be stacked on top of the top surface 13 of the case 11. In practice, at least some of the construction toy blocks (viz. those numbered 5 and 7) may also comprise pegs 17 similar to and compatible with the pegs 15 to allow such blocks to be stacked one above the other for playing purpose. This kind of toy construction block has been known for decades and need not be further described.

Thus, it may be understood that the top surface 13 of the case 11 can be used as a conventional construction toy base to stack construction toy blocks 5,7,9, either on the ground (when the top surface 13 is removed from the case 11) or on the case 11 (when the top surface 13 is fitted to it).

Figure 5:
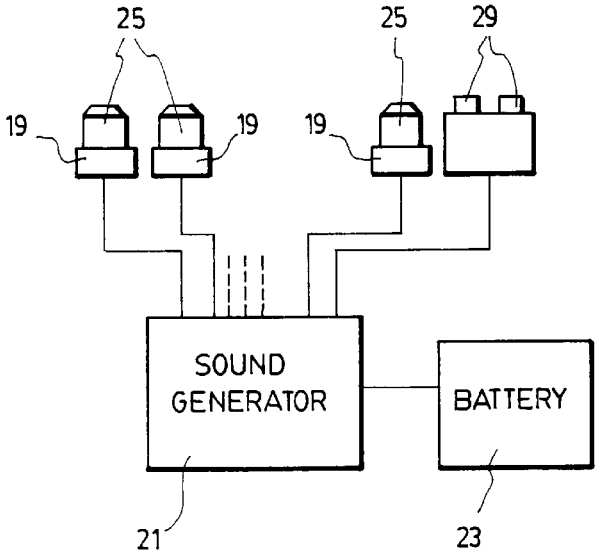
FIG. 5 is a schematic representation of the electronic circuit of the music toy kit shown in FIGS. 1 and 2.

The piano 3 also comprises a set of keys 19 corresponding to different notes. As is shown in FIGS. 1 and 2, the keys 19 are aligned on a front side of the case 11 to form a keyboard 21. As is also shown in FIG. 5, each of the keys 19 is connected to an electronic sound generator 21 operated by one or more batteries 23 in such a manner as to produce the corresponding note upon actuation of the key. Sound generators like the one 21 used in the kit according to the present invention are very conventional in the toy industry and need not be further described.

In accordance with a first essential aspect of the invention, each key 19 is provided with identification means. In the preferred embodiments illustrated in the accompanying drawings, such identification means consist of colored pegs 25 similar to the pegs 15 and 17 projecting from the top surface 13 of the case 11 and from the construction toy blocks 5 and 7, respectively. Instead of such colored pegs, use could alternatively be made of other identification means, such as tags, block letters and the like. However, the advantage of using pegs 25 is that the child playing with the kit 1 may also use the keyboard 21 as a construction toy base whenever he or she wants it.

In accordance with a second essential aspect of the invention, at least some of the construction toy blocks, viz. those numbered 5, have at least one side provided with a score 27 wherein the notes to be played are identified with the identification means of the corresponding keys 19 of the piano 3, viz. in the present case with the same color. As a result, these blocks can be used as a combined music stand and score to play a given tune when they are stacked onto the case.

Preferably, the sound generator 21 is devised to play tunes corresponding to the scores provided on the construction toy blocks 5 upon actuation of one or more buttons 29 provided on the case. This feature permits to the children to "learn" the tunes prior to trying to play it. This feature also makes the kit useful as a music player.

Figure 6:
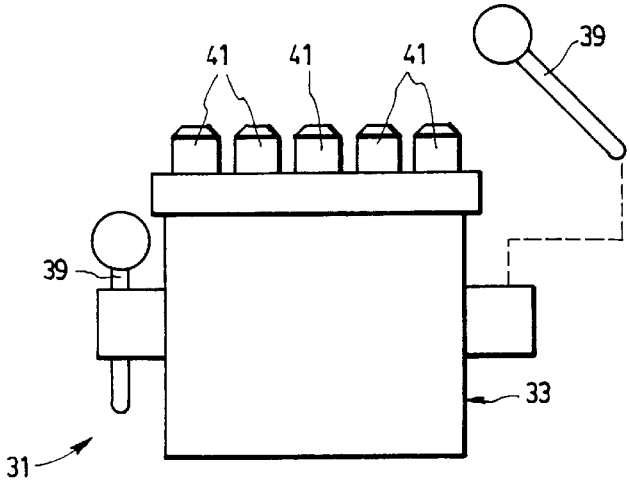
FIG. 6 is a front elevational view of a music toy kit according to a second embodiment of the invention, wherein the music toy instrument is shaped as a drum.

The music toy kit 31 according to the second preferred embodiment of the invention shown in FIG. 6 is similar to the kit 1 and comprises the very same structural components. Its only difference is that the music toy instrument 33 is not shaped as a piano but as a drum, with a plurality of keys on its top surface. which a child may hit with one or two drum sticks 39. In such a case, the colored pegs 41 projecting from the keys act not only as identification means but also as coupling elements for use to connect construction toy blocks onto the case.

Of course, the music toy instrument could take other shapes. It could also be "decorated" to look like a toy character (see the face 51, feet 53 and hands 55 in FIGS. 1 and 2). Furthermore, some of the construction toy blocks (like those numbered 7) of the kit could be shaped as music instruments to give an additional interest to the kit.

Of course, numerous other modifications could be made to the embodiments disclosed hereinabove without departing from the scope of the present invention as broadly disclosed hereinabove.

What is claimed is:

1. A music toy kit comprising, in combination:

b) a music toy instrument comprising:

a case;

a set of keys corresponding to different notes, each of the keys being provided with identification means and being connected to a sound generator embedded into the case for producing a corresponding note upon actuation of said key; and coupling elements integral to the case for use to connect construction toy blocks onto said case; and b) a plurality of said construction toy blocks provided with coupling elements compatible with those integral to the case, at least some of said construction toy block having at least one side provided with a score wherein the notes to be played are identified with the identification means of the corresponding keys of the music toy instrument, whereby, in use, one may stack one or more of the construction toy blocks onto the case of the music toy instrument and use said one or more blocks as a combined music stand and score to play a given tune by proper actuation of the corresponding keys.

2. The music toy kit of claim 1, wherein the case has a top surface and the coupling elements integral to said case consist of pegs projecting vertically from at least said top surface.

3. The music toy kit of claim 2, wherein the identification means of the keys consist of colored pegs compatible with the coupling elements of the construction toy blocks.

4. The music toy kit of claim 3, wherein the sound generator is a battery operated, electronic device.

5. The music toy kit of claim 4, wherein the sound generator is devised to play tunes corresponding to the scores provided on the construction toy blocks upon actuation of a button provided on the case.

6. The music toy kit of claim 5, wherein the case is hollow and defines a container for storing the construction toy blocks.

7. The music toy kit of claim 6, wherein the music toy instrument is shaped as a piano and the keys are aligned on a front side of said case to form a keyboard.

8. The music toy kit of claim 6, wherein the music toy instrument is shaped as a drum and has a top surface on which the keys are equally distributed.

9. The music toy kit of claim 2, wherein the case is hollow and defines a container for storing the construction toy blocks.

10. The music toy kit of claim 9, wherein the music toy instrument is shaped as a piano and the keys are aligned on a front side of said case to form a keyboard.

11. The music toy kit of claim 9, wherein the music toy instrument is shaped as a drum and has a top surface on which the keys are equally distributed.

* * * * *

UNITED STATES PATENT AND TRADEMARK OFFICE

CERTIFICATE OF CORRECTION

PATENT NO. : 6,132,281
DATED : October 17, 2000
INVENTOR(S) : Daniel Klitsner, Brian Clemens, Christian Lemire, Solange Jacques, Drew Stevenson It is certified that error appears in the above-identified patent and that said Letters Patent is hereby corrected as shown below:

Claim 1,
Line 2, "b)" should be replaced by -- "a)" --

Column 4, claim 1,
Line 13, "block" should read -- blocks. --

Signed and Sealed this

Fifth Day of March, 2002

*Attest:*

*Attesting Officer*

JAMES E. ROGAN
*Director of the United States Patent and Trademark Office*